United States Patent [19]

Sada et al.

[11] 4,310,253

[45] Jan. 12, 1982

[54] STIRRING METHOD

[75] Inventors: Eizo Sada, Takatsuki; Shigeo Katoh; Ryozo Toei, both of Kyoto; Hideyuki Michiki, Mobara, all of Japan

[73] Assignee: Toyo Engineering Corporation, Tokyo, Japan

[21] Appl. No.: 132,847

[22] Filed: Mar. 24, 1980

[30] Foreign Application Priority Data

Mar. 29, 1979 [JP] Japan ..... 54-36230

[51] Int. Cl.[3] ..... B01F 13/08; B01F 13/10

[52] U.S. Cl. ..... 366/273; 261/84; 366/292

[58] Field of Search ..... 366/273, 274, 292; 261/84

[56] References Cited

U.S. PATENT DOCUMENTS 3,219,318 11/1965 Hershler ..... 366/273

*Primary Examiner*—Philip R. Coe

[57] ABSTRACT

A stirring method comprising placing particles of a magnetic material or particles of a magnetic material coated or covered with a non-magnetic material in an interface between two phases or in a specific layer, and subjecting said particles to influences of a rotating magnetic field to cause rotation and revolution in the particles. According to this method, transfer of substances and/or heat in the interface between the two phases or in the specific layer is promoted. Also disclosed is a stir method comprising placing particles of a magnetic material or particles of a magnetic material coated or covered with a non-magnetic material in a fluid under influences of a rotating magnetic field, to cause rotation and revolution in the particles in the fluid. According to this method, transfer of substances and/or heat in the interface between a phase of the particles and a phase of the fluid is promoted.

9 Claims, 7 Drawing Figures

STIRRING METHOD

BACKGROUND OF THE INVENTION

1. Field of the Invention

The present invention relates to a stirring method. More particularly, the present invention relates to a stirring method comprising moving particles consisting of or comprising a magnetic material under the influences of a rotating magnetic field to prominently promote the transfer of substances and/or heat in liquid-gas phases, liquid-liquid phases, liquid-solid phases or in liquids.

2. Description of the Prior Art

In the industrial fields, there are many operations requiring the transfer of substances and/or heat between two fluid phases including a liquid, for example, gas-liquid phases, liquid-liquid phases or solid-liquid phases. It is well known that in these operations, the resistance against the transfer of substances and/or heat is present mainly in the vicinity of the interface between two phases. In order to decrease such resistance and enhance the transfer rate between the two phases, it is necessary to cause a disturbance in the interface between the two phases. However, there has not been developed any method for effectively causing a disturbance in the interface between the two phases in the vicinity thereof. Therefore, a method for stirring the liquid entirely has heretofore been adopted. Stirring the entire liquid is effective for improving the transfer rate in the liquid, but the effect of increasing the transfer rate in the interface between the two phases and in the vicinity thereof is not so prominent as compared with consumption of stirring power.

Furthermore, there has not been developed an effective stirring method to be applied to the case where in a system comprising at least two liquid layers differing in density, one specific liquid layer alone should be selectively stirred.

Still further, there has not been developed an effective stirring method to be applied to the case where in conducting a reaction while moving a liquid in a tank or column by piston flow, a specific layer alone should be selectively stirred.

In the industrial fields, there are many operations requiring transfer of substances and/or heat in solid-liquid phases, gas-solid phases or liquid-liquid phases, such as reactions using a solid catalyst or immobilized enzyme or dissolution of solid or adsorption.

In these operations, resistance against the transfer of substances and/or heat is present mainly in the vicinity of the interface between the particulate solid and the fluid, as is well known in the art. In order to decrease this resistance and enhance the transfer rate between the two phases, there has heretofore been adopted a method in which only the fluid is entirely stirred. Stirring the entire fluid is effective for increasing the transfer rate in the fluid, but the effect on improving the transfer rate between the phase of fine particles and the fluid phase is not so prominent as compared with consumption of the stirring power.

SUMMARY OF THE INVENTION

It is a primary object of the present invention to provide an stirring method in which a disturbance is caused selectively in the interface between two phases or in the vicinity thereof or in a specific layer of a liquid, thereby to promote transfer of substances and/or heat.

A secondary object of the present invention is to provide a stirring method in which particles consisting of or comprising a magnetic material are moved under the influence of a rotating magnetic field, thereby to promote the transfer of substances or the transfer of heat between a phase of fine particles and a fluid phase.

In accordance with a first fundamental aspect of the present invention, there is provided a stirring method comprising placing particles of a magnetic material or particles of a magnetic material coated or covered with a non-magnetic material in the interface between two phases or in a specific layer, and subjecting said particles to the influence of a rotating magnetic field to cause rotation and revolution of the particles, whereby transfer of substances and/or heat in the interface between the two phases or in the specific layer is promoted. This stirring method is effective for attaining the primary object of the present invention.

In accordance with a second fundamental aspect of the present invention, there is provided a stirring method comprising placing particles of a magnetic material or particles of a magnetic material coated or covered with a non-magnetic material in a fluid under the influence of a rotating magnetic field, to cause rotation and revolution of the particles in the fluid, whereby transfer of substances and/or heat in the interface between a phase of the particles and a phase of the fluid is promoted. This stirring method is effective for attaining the secondary object of the present invention.

DETAILED DESCRIPTION OF THE PREFERRED EMBODIMENTS

As pointed out hereinbefore, according to the first aspect of the present invention, particles of a magnetic material or particles of a magnetic material coated or covered with a non-magnetic material are placed in the interface between two phases or in a specific layer of a liquid system and they are subjected to the influence of a rotating magnetic field to cause rotation and revolution in the particles.

This aspect will now be described with reference to an embodiment in which the interface between gas and liquid phases and the vicinity thereof are stirred.

BRIEF DESCRIPTION OF THE DRAWINGS

This embodiment is diagrammatically illustrated in FIG. 1. Referring to FIG. 1, a gas phase 2 is present in the upper portion of a vessel 1 and a liquid phase 3 is present in the lower portion of the vessel 1, and magnetic particles 4 are floated in the interface between the gas and liquid phases. A permanent magnet 5 is disposed in the gas phase 2 at a point spaced a certain distance from the interface and a stir vane 6 is disposed in the liquid phase at a position spaced a certain distance from the interface. The magnetic particles 4 are composed of a magnetic material, for example, tri-iron tetroxide, and the particles are coated with paraffin or the like so that the specific gravity of the magnetic particles 4 is smaller than the density of the liquid and they are allowed to float in the interface between the two phases at positions just below N and S poles of the permanent magnet 5.

Figure 1:
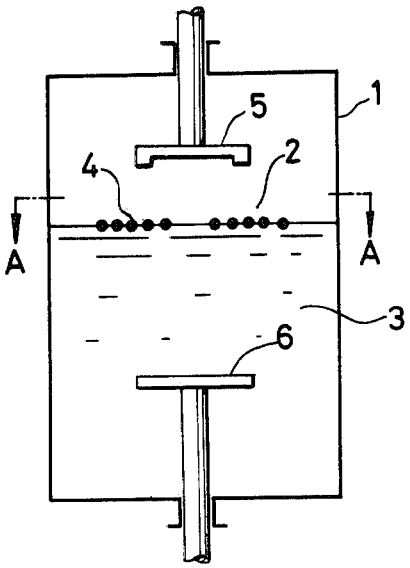
FIG. 1 is a diagram illustrating one embodiment of the stirring method of the present invention in which magnetic particles are arranged in the interface between a gas phase and a liquid phase to stir the interface and the vicinity thereof.
Figure 1A:
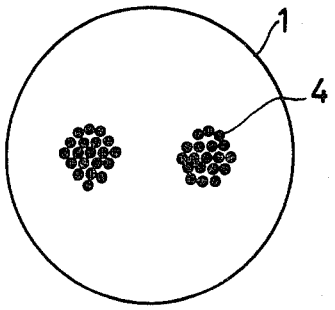
FIG. 1*a* is a sectional view of FIG. 1 as seen from A—A.

If the permanent magnet 5 is rotated in this state while stopping the stirring vane 6, the magnetic particles 4 are revolved in the interface in the same direction as the rotation direction of the permanent magnet 5 with rotation of the permanent magnet 5, and simultaneously, rotation is caused in the respective magnet particles 4. As a result, disturbance is caused in the interface between the two phases and in the vicinity thereof, and the speed of transfer of substances and/or heat is improved. However, since the stirring vane 6 in the liquid phase is kept stationary, even though the transfer speed in the interface is improved, the component or heat absorbed in the liquid is diffused in the liquid only at a very low speed. If both the permanent magnet 5 and the stirring vane 6 are rotated, diffusion of the absorbed component or heat is accelerated and the transfer speed between the gas and liquid phases can be remarkably improved.

Ordinarily, magnetic particles 4 are prepared either by coating finely divided or particulate magnetic materials such as tri-iron tetroxide with an organic material such as paraffin or plastic or an inorganic material such as glass or prepared by pulverizing the mixture of the magnetic materials with said organic or inorganic materials to a predetermined size. When the magnetic particles 4 are used in the interface between gas and liquid phases as in the present embodiment, the ratio between the magnetic material and the surrounding non-magnetic material should be arranged so that the specific gravity of the magnetic particles 4 is smaller than the density of the liquid. However, even if the specific gravity of the magnetic particles 4 is equal to or larger than the density of the liquid, the magnetic particles 4 can be maintained in the interface between the two phases by appropriately adjusting the distance between the permanent magnet 5 and the magnetic particles 4 and the intensity of the permanent magnet 5. The kind of the non-magnetic material to be used for covering or coating the magnetic particles 4 is appropriately selected taking into consideration the properties of the gas and liquid, especially those of the liquid, and the operational conditions.

As pointed out hereinbefore, the magnetic particles are formed by mixing, coating or covering a magnetic material with a non-magnetic material, optionally together with a substance having a specific capacity such as a dissolving capacity, an adsorbing capacity or a catalytic activity. In the present invention, magnetic particles consisting solely of a magnetic material may be used. Also in this case, only the magnetic property of the magnetic material is utilized, or other properties possessed by the magnetic material, such as the dissolving capacity, the adsorbing capacity and the catalytic activity may be utilized in combination with the magnetic property.

The above description has been made with reference to the embodiment where stirring is caused in the interface between gas and liquid phases and in the vicinity thereof. When it is desired to cause a disturbance in the interface in phases of gas, liquid I and liquid II, phases of liquid I and liquid II or phases of liquid and solid and the vicinity of such interface, the specific gravity of the magnetic particles 4, the intensity of the permanent magnet 5 and the distance between the permanent magnet 5 and magnetic particles 4 may be appropriately set depending on the density of the liquid to be stirred and disturbed.

When a system including three liquid phases is stirred, for example, when it is desired to selectively stir a specific phase among the three phases, the specific gravity of the magnetic particles 4 may be arranged depending on the density of the liquid of the specific phase or the intensity and distance of the permanent magnet 5 may be appropriately set according to the density of the liquid of the specific phase.

Furthermore, the stirring method of the first aspect of the present invention may be applied to stirring a specific layer in a liquid system in which the density or viscosity gradually changed from the top toward the bottom or from the bottom toward the top or a liquid system requiring piston flow, by appropriately combining the above-mentioned factors.

In the foregoing embodiment, the rotating magnetic field is generated by rotation of the permanent magnet. In the present invention, an electromagnet may be used instead of the permanent magnet. Moreover, the magnetic field may be generated by application of electric current, especially a three-phase alternating current.

In the foregoing embodiment, an instrument generating a rotating magnetic field (the permanent magnet 5 in the foregoing embodiment) is placed in the vessel 1. In the present invention, there may be adopted a modification in which the instrument is located outside the vessel and arranged so that the instrument acts through the vessel wall composed of a non-magnetic material. Moreover, a specific vertical or inclined layer in the liquid phase may be stirred by appropriately designing the rotating magnetic field. Still further, there may be adopted a modification in which electromagnets are disposed above and below magnetic particles and an electric current is applied alternately to the upper and lower electromagnets to move the magnetic particles vertically with the interface being within the center or in the specific layer. Furthermore, a vertical movement can be given to the magnetic particles by this arrangement while the particles are horizontally moved by rotating the above-mentioned permanent magnet.

An example of the method of the first aspect of the present invention will now be described in detail with reference to the accompanying drawings and experimental data.

Figure 2:
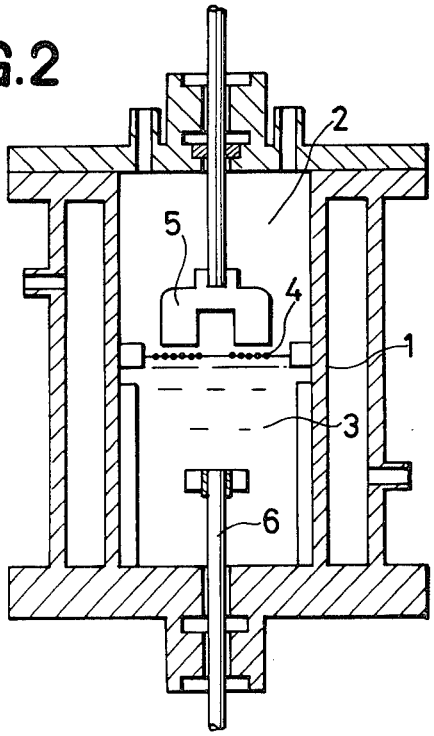
FIG. 2 is a view showing the longitudinal section of an apparatus used for experiments.

FIG. 2 is a diagram illustrating the experiment apparatus, in which each reference numeral has the same meaning as in FIG. 1. The inner diameter of the vessel 1 is 80 mm, and the inner diameter on the interface is 60 mm. The distance between the permanent magnet 5 and the interface is 4 mm. The intensity of the permanent magnet 5 is 1000 Gauss. Magnetic particles 4 are formed by incorporating 2.5 g of $Fe_3O_4$ and 1 G of a surface active agent into 18 g of paraffin molten at 70° C., stirring the mixture sufficiently, pouring the mixture into cold water to rapidly solidify the mixture, pulverizing the solid and gathering particles having a size of 200 to 500 μ.

Figure 3:
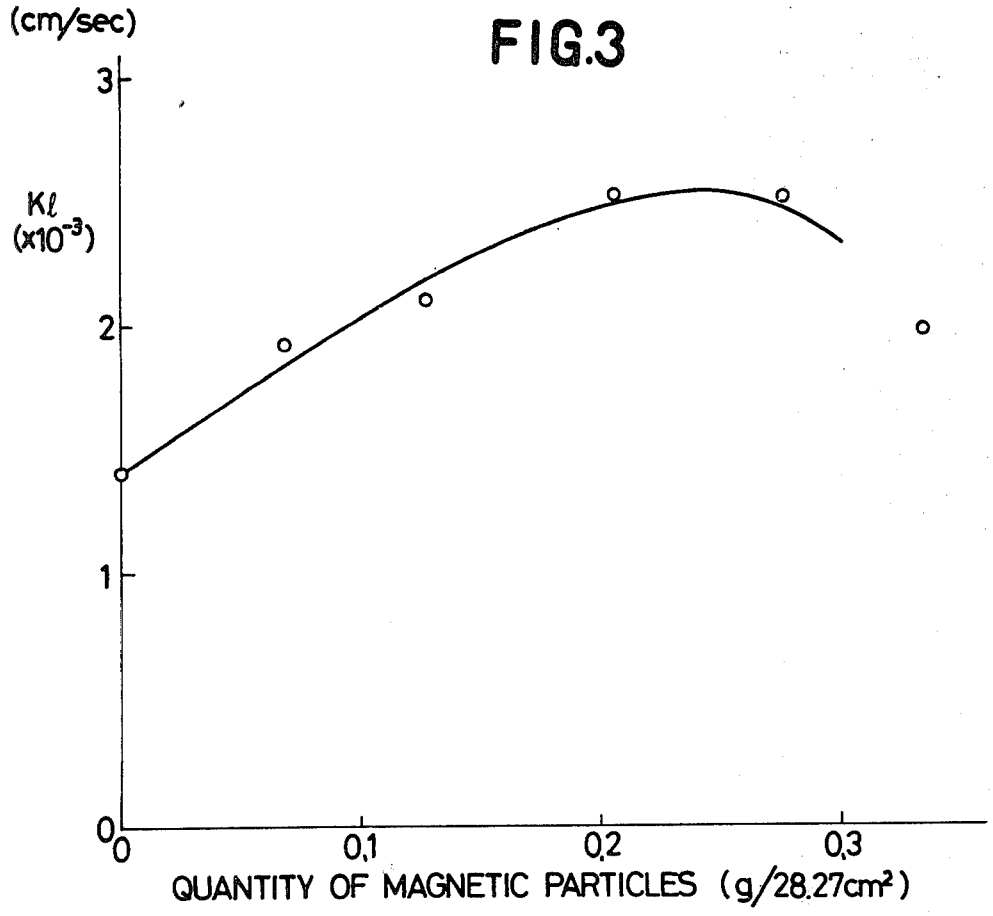
FIG. 3 is a diagram illustrating the influence of the quantity of magnetic particles on the substance transfer coefficient on the liquid side in a carbon dioxide gas-water system.

In a carbon dioxide gas-water system, at a temperature of 30° C., the permanent magnet 5 is rotated at 580 rpm and the stirring vane 6 is rotated at 200 rpm. The influence of the quantity (g/28.27 $cm^2$ interface) (abscissa) of the magnetic particles on the mass transfer coefficient (Kl cm/sec) (ordinate) on the liquid side are shown in FIG. 3. As is seen from the Curve of FIG. 3, the maximum value of Kl appears at a point where the quantity of the magnetic particles is about 0.24 g/28.27 $cm^2$, and if the quantity of the magnetic particles is increased beyond this point, the value Kl is decreased. It is considered that this may be due to mutual interference of the magnetic particles and decrease of the area of the interface.

If the particle size of the magnetic particles is too small, the value of Kl is decreased. Accordingly, it is preferred that the particle size be substantially equal to the thickness of the laminar sublayer on the liquid side. More specifically, the value of Kl varies depending on the properties and states of the gas and liquid, the intensity and strength of the permanent magnet and the properties, size and quantity of the magnetic particles. Therefore, in practising the stirring method of the present invention, these factors should be arranged so that an optimum value of Kl will be obtained.

In the experimental apparatus shown in FIG. 2, at a temperature of 30° C., stirring is carried out by using 0.21g/28.27 $cm^2$ of the above-mentioned magnetic particles having a size of 200 to 500 μ. Carbon dioxide gas is used as the gas phase 2 and a 0.8% by weight aqueous solution of NaOH, pure water or a 40% by weight aqueous solution of glycerin is used as the liquid phase 3. The test results obtained are shown in FIG. 4.

Figure 4:
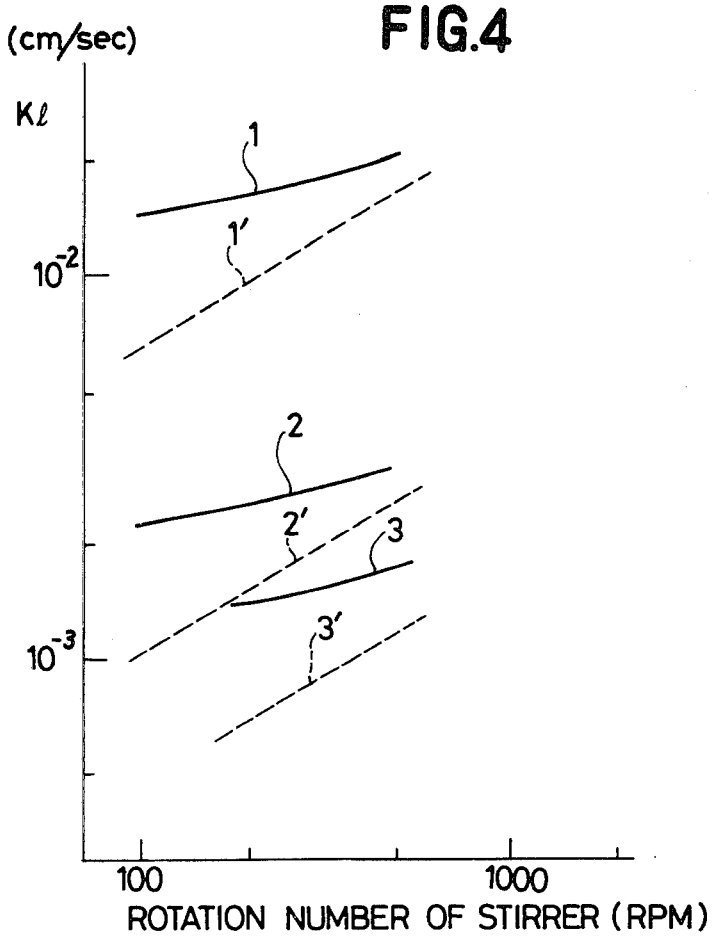
FIG. 4 is a diagram comparing the method of the present invention with the conventional method with respect to the substance transfer coefficients on the liquid side in a carbon dioxide gas—0.8% by weight aqueous NaOH system, a carbon dioxide gas-water system and a carbon dioxide gas—40% by weight aqueous glycerin system.

The logarithmic scale is adopted for each of the abscissa and ordinate in FIG. 4, and the value of Kl (cm/sec) is plotted on the ordinate and the number of revolutions (rpm) of the stirring vane 6 is plotted on the abscissa. Solid and dotted lines show results obained when the permanent magnet 5 is rotated at 580 rpm and 0 rpm, respectively. Curves 1 and 1' show results obtained in the carbon dioxide gas—0.8% by weight aqueous NaOH system, curves 2 and 2' show results obtained in the carbon dioxide gas-water system, and curves 3 and 3' show results obtained in the carbon dioxide gas—40% by weight aqueous glycerin system.

As is seen from the results shown in FIG. 4, in each system, a higher Kl value is obtained according to the method of the present invention (curves 1, 2 and 3) than in the conventional method (curves 1', 2 and 3'). It will also be understood that when the permanent magnet is rotated, as the number of revolutions of the stirring vane is increased, the value Kl is increased. However, as the number of revolutions of the agitation vane is increased, the difference of the value Kl between the curves 1 and 1', 2 and 2' or 3 and 3' becomes small, and though not shown in FIG. 4, if the revolutions of the stirring vane exceed a certain number, independently from the fact whether the permanent magnet is rotated or is kept stationary, the value Kl is substantially the same and in this region, attainment of the effect of the present invention cannot be expected.

In the foregoing illustration, the magnetic particles are moved by rotation of the permanent magnet 5 to effect stirring of the interface and the liquid phase is stirred by the stirring vane 6. The value Kl obtained in the above case is compared with the Kl value obtained when the stirring vane 6 is not rotated at all revolution number being equal to 0 rpm). At this test, adsorption of the gas is examined in a $CO_2$-water system at a temperature of 30° C. by rotating the permanent magnet 5 at 580 rpm and using the magnetic particles in an amount of 0.21 g/28.27 $cm^2$. The results obtained are shown in Table 1.

TABLE 1

| Number of Rotations (rpm) of Stirring Vane | Kl Value ($\times 10^{-3}$cm/sec) |
|---|---|
| 430 | 2.80 |
| 200 | 2.51 |
| 130 | 2.34 |
| 0 | 1.52 |

As it will be apparent from the results shown in Table 1, when the number of revolution of the stir vane is 0 rpm and the revolution number of the permanent magnet are 580 rpm, the obtained Kl value is $1.52\times10^{-3}$ cm/sec. When this value is compared with the Kl value shown by the dotted line curve 2' in FIG. 4 (the number of revolutions of the permanent magnet is 0 rpm), it is seen that the above-mentioned value corresponds to the Kl value obtained when the stirring vane is rotated at about 200 rpm. Therefore, it will readily be understood that even if stirring of the entire liquid is not effected, a high effect can be attained according to the first aspect of the present invention.

Figure 5:
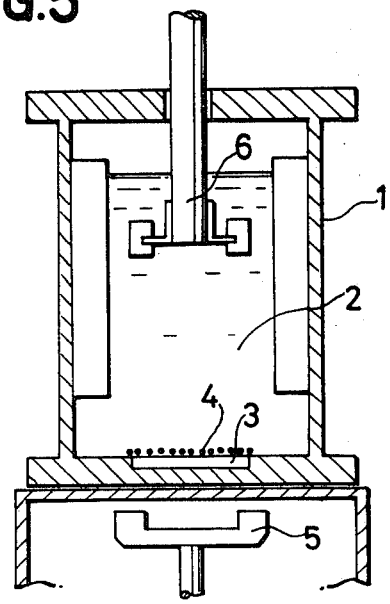
FIG. 5 is a view showing the longitudinal section of an apparatus used for the solid dissolution promotion test.

An example in which the first aspect of the present invention is applied, i.e. to the promotion of dissolution of the solid in the solid-liquid phase will now be described. A magnetic stirrer used is illustrated in FIG. 5. Water 2 is charged in the vessel of the magnetic stirrer and a thin plate of benzoic acid 3 is fixed to the bottom of the vessel in a circular area having a diameter of 25 mm. In this example, 0.07 g of magnetic particles 4 having a size of 200 to 500 μ are used. A 6-vane type turbine stirrer 6 is rotated at 70 or 140 rpm. A permanent magnet 5 is rotated without using the magnetic particles 4 or while using 0.07 g of the magnetic particles 4 having a size of 200 to 500 μ and a specific gravity slightly larger than the density of water, and the Kl value is determined to obtain the results shown in Table 2.

TABLE 2

| Rotation (rpm) of Turbine Stirrer | Kl Value ($\times 10^{-3}$cm/sec) Magnetic Particles Not Used | Magnetic Particles Used |
|---|---|---|
| 70 | 1.50 | 2.69 |
| 140 | 1.62 | 2.72 |

In the above example, magnetic particles having a size of 200 to 500 μ are used in a quantity of 0.21 g/28.27 $cm^2$ for causing stirring in the interface between the liquid and solid phases. The size and quantity of the magnetic particles used are appropriately selected depending on the kind of system to be treated. Ordinarily, it is preferred that the size of the magnetic particles be substantially equal to the thickness of the laminar sublayer on the liquid side and that the size be as uniform as possible among the magnetic particles. Use of magnetic particles having too small a size should be avoided because the interface is covered by the magnetic particles. There is an optimum value of the quantity of the magnetic particles, which provides a maximum value of the mass transfer coefficient on the liquid side, according to the particle size and size distribution of the magnetic particles. Accordingly, it is preferred that the magnetic particles be used in a quantity close to this optimum value. Of course, the intended effect cannot be attained if the quantity of the magnetic particles is too small or too large.

According to the method of the first aspect of the present invention, transfer of substances and/or heat can be remarkably promoted while reducing the transfer resistance on the liquid side. Therefore, this method can be effectively applied to various industrial fields. For example, in the field of absorption of gas by stirring of the interface between gas and liquid phases, especially good effects can be obtained according to this method when this method is applied to the case where the liquid phase is a highly viscous liquid or viscoelastic fluid while a high effect is not attained by stirring of the liquid phase in the case where the liquid phase is a thin layer, or where absorption of gas is effected in a tube, the case where an apparatus having such a structure as will not allow insertion of a stirrer or where the shape of the interface between the gas and liquid phases is complex. In the case where an irregularly shaped filter membrane or a filter membrane which is readily broken under violent stirring is employed, if rotation and revolution of magnetic particles are caused in a layer in the vicinity of the filter membrane according to the method of the first aspect of the present invention, especially good results are obtained, and this application is included in the scope of the present invention. Furthermore, the method of the first aspect of the present invention can be effectively applied to the case where in a separation operation using a membrane, for example, an ultrafiltration operation, the concentration polarization is moderated in the vicinity of the membrane surface, and also this application is included in the scope of the present invention.

In the field of liquid-liquid extraction, two liquids are mixed by stirring the entire liquid system according to the conventional method. The method of the first aspect of the present invention can be effectively applied to liquid-liquid extraction when mingling of the two liquids is not desired. In an operation of letting liquid drops fall in a sealed vessel, the magnetic particles are rotated and revolved selectively in the liquid drops. This may be regarded as a special application of the method of the first aspect of the present invention. Furthermore, the method of the first aspect of the present invention can be applied to stirring the surface of a solvent phase. In this case, the surface of the magnetic particles can be rendered hydrophilic or hydrophobic.

The stirring method of the second aspect of the present invention will now be described.

According to the second aspect of the present invention, particles of a magnetic material or particles of a magnetic material coated with a non-magnetic material are placed in a fluid under influence of a rotating magnetic field, to cause rotation and revolution of the particles in the fluid, whereby transfer of substances and/or heat in the interface between a phase of the particles and a phase of the fluid is promoted.

The method of the second aspect of the present invention is different from the above-mentioned method of the first aspect of the present invention in the point that by rotation and revolution of magnetic particles in a fluid, the transfer resistance between the phase of the particles and the phase of the fluid is reduced and stirring is effected in the entire area, while in the method of the first aspect of the present invention, stirring is caused only in the interface between two phases or in a specific layer.

In the method of the second aspect of the present invention, a substance having a dissolving capacity, a substance necessary for the reaction or a substance having a specific function such as an absorbing capacity or catalytic action should be present in the magnetic particles irrespective of whether or not the entire fluid is stirred or whether the magnetic particles are composed of a magnetic material alone or of a magnetic material and a non-magnetic material, and in this state, these magnetic particles should be rotated and revolved. The magnetic particles and the manner of generation of the rotating magnetic field will be readily understood from the foregoing illustrations made with reference to the method of the first aspect of the present invention.

An example of the method of the second aspect of the present invention will now be described. In this example, the speed of decomposition of urea in the decomposition reaction using a fixed urease is promoted according to the stirring method of the second aspect of the present invention. The fixed urease is prepared by stirring a hydrophobic mixture of 144 $cm^3$ of toluene, 56 $cm^3$ of chloroform, 0.5 g of a surface active agent (sorbitan sesqui-oleate) and 0.16 g of an initiator (N,N,N',N'-tetramethyl-ethylenediamine) at 0° to 4° C. in a nitrogen atmosphere, adding 26 $cm^3$ of a hydrophilic mixture containing 50 mg of urease, 5.6 g of acrylamide monomer, 0.28 g of a crosslinking agent (N,N'-methylenebisacrylamide), 5.0 g of $Fe_3O_4$, 0.3 g of an enzyme stabilizer (disodium ethylenediamine-tetraacetate) and 0.05 mole of a potassium phosphate buffer to the above hydrophobic mixture being stirred, adding a mixture of 100 mg of ammonium persulfate and 1 ml of 0.05 mole of potassium phosphate buffer as an initiator to the above mixture, stirring the resulting mixture to form magnetic particles and removing large particles from the so formed magnetic particles by using a 32-mesh sieve.

Figure 6:
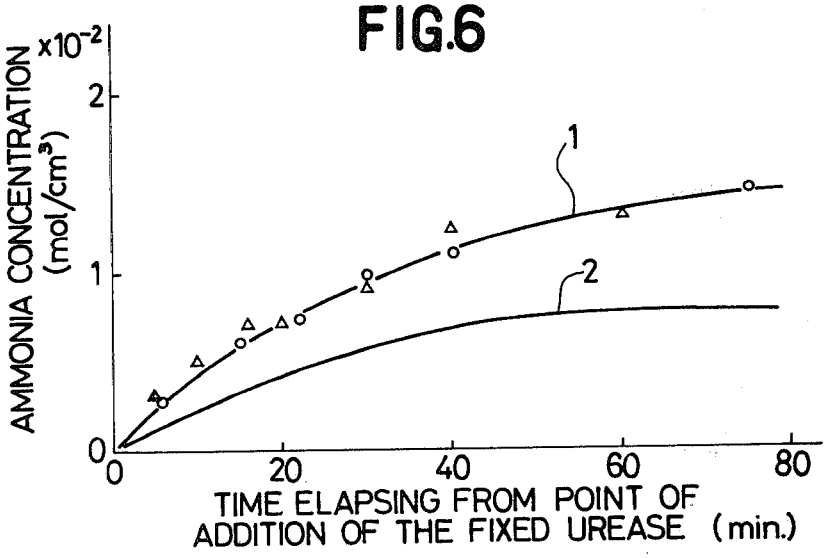
FIG. 6 is a diagram illustrating the change of the ammonia concentration with lapse of the time, observed when the method of the present invention is applied to decomposition of a urea solution by a fixed urease.

In a glass vessel are charged 20 $cm^3$ of a urea solution having a concentration of $1.0\times10^{-6}$ mole/$cm^3$, and the solution is maintained at 30° C. A permanent magnet located in the lower portion of the vessel is rotated to generate a rotating magnetic field. Then, 2 $cm^3$ of the above-mentioned fixed urease are incorporated in the urea solution, and the concentration of ammonia formed by decomposition of urea is measured to obtain the results shown in FIG. 6. Results obtained when the permanent magnet is rotated are compared with results obtained when the permanent magnet are not rotated. In FIG. 6, the ordinate indicates the ammonia concentration (mole/$cm^3$) and the abscissa indicates the time (minutes) elapsing from the point of addition of the fixed urease. Curve 1 shows results obtained when the rotating magnetic field is generated, and curve 2 shows results obtained when the rotating magnetic field is not generated. The fixed urease used at the experiment marked by symbol O on curve 1 is allowed to stand still for 10 days and is then is tested under the same conditions. The measured ammonia concentration is indicated by mark Δ in FIG. 6. It will be understood that the activity of the fixed urease is not lowered by standing.

As will be apparent from the foregoing illustration, the method of the second aspect of the present invention can be applied to stirring in the interface between solid and liquid phases in various fields. For example, a magnetic material is added to porous solid absorbent particles, for example, active carbon particles, and the adsorbent particles are rotated to reduce the resistance to transfer of substances in the interface between the particle phase and the liquid phase. Furthermore, a magnetic material is supported on solid catalyst particles or particles of an immobilized enzyme, and the particles are rotated to reduce the resistance to transfer of substances in the interface between the particle phase and the liquid phase. Moreover, in a chemical operation conducted under fluidization or migration, a magnetic material is supported on particles to be fluidized or moved, and rotation and disturbance are caused in the particles. When a solid catalyst, solid absorbent of fixed enzyme suspended in a fluid is readily broken under strong stirring, if the stirring method of the second aspect of the present invention is practised while using a stirring vane for the fluid shaped so as to reduce such damage or by rotating a stirring vane for the fluid at a small revolution number or reducing the revolution number to zero, the solid catalyst, solid adsorbent or fixed enzyme can be effectively prevented from damages.

In addition to the above-mentioned application modes of the methods of the first and second aspects of the present invention, there are many other application modes.

As it is apparent from the foregoing illustration, according to the first or second aspect of the present invention, the rate of transfer of substances and/or heat in the interface between two phases can be remarkably increased. Furthermore, there can be attained various advantages by providing appropriate arrangements. For example, the magnetic particles are maintained in the system while preventing the system from effusion of the magnetic particles. Furthermore, there may be adopted an advantageous modification in which parts of the magnetic particles are taken out from the system by temporarily weakening the intensity of the magnetic field or the magnetic particles are partially or entirely removed by temporarily cancelling the magnetic field or changing the intensity of the magnetic field, and the magnetic particles are separated from the operation fluid or the like outside the system by utilizing another magnetic field. What is claimed is:

1. Method for magnetically and selectively stirring substances in a vessel containing them, which comprises:

(a) placing a predetermined quantity of comminuted magnetic material at a preselected location in said vessel, said magnetic material being covered with a non-magnetic material so as to possess a predetermined specific gravity;

(b) placing in said vessel and above said comminuted magnetic material movable means for rotating said magnetic material under the influence of a variable rotating magnetic field generated by said movable means;

(c) adjusting said rotating magnetic field to a predetermined rotational speed and said movable means to a predetermined distance from said magnetic material; and (d) causing said movable means to stir said substances selectively in said vessel, thereby obtaining a transfer of the thus stirred substances in said vessel.

2. The method according to claim 1, further comprising:

(a) placing in said vessel and below said comminuted magnetic. material mechanically-actuated stirring means for additionally stirring said substances in said vessel, whereby said substances are selectively stirred by the combined stirring action of said movable means and said mechanically-actuated stirring means for the obtainment of a transfer of the thus stirred substances in said vessel.

3. The method according to claims 1 or 2, wherein said comminuted magnetic material consists of particles of magnetic material individually or plurally coated by non-magnetic material.

4. The method according to claim 1 or 2, wherein one or more specific non-magnetic materials are combined with said magnetic material, the resulting combination being covered by said non-magnetic material.

5. The method according to claim 4, wherein said non-magnetic material consist of said specific non-magnetic material.

6. The method according to claim 5 or 2, wherein said preselected location is selected from the group consisting of the interface between two fluids in a multi-phase system, the interface between two liquids in a multi-liquid system, one liquid in a multi-liquid system and one phase in a multi-phase system.

7. The method according to claim 6, wherein said multi-phase system is selected from the group consisting of gas-liquid systems, liquid-solid systems and gas-liquid-solid ternary systems.

8. The method according to claim 1 or 2, wherein said magnetic material consists of comminuted iron oxide covered with a non-magnetic material selected from the group consisting of paraffin, plastic material, and glass.

9. The method according to claim 1 or 2, wherein said movable means for rotating said magnetic material is selected from a rotating magnet or a permanent magnet or an electromagnet or a three-phase alternating electric current.

* * * * *